US007757995B2

(12) United States Patent
McKiernan

(10) Patent No.: US 7,757,995 B2
(45) Date of Patent: Jul. 20, 2010

(54) TRAINLINE SUPPORT BRACKET

(75) Inventor: Kevin McKiernan, Hillsborough, NJ (US)

(73) Assignee: EOC Railcar Solutions, LLC, Branchville, NJ (US)

( * ) Notice: Subject to any disclaimer, the term of this patent is extended or adjusted under 35 U.S.C. 154(b) by 65 days.

(21) Appl. No.: 11/437,472

(22) Filed: May 19, 2006

(65) Prior Publication Data

US 2007/0267377 A1 Nov. 22, 2007

(51) Int. Cl.
*F16L 3/00* (2006.01)

(52) U.S. Cl. ..... 248/53; 213/75 R

(58) Field of Classification Search ..... 213/75 R, 213/211; 248/53, 551, 75, 65
See application file for complete search history.

(56) References Cited

U.S. PATENT DOCUMENTS 3,344,935 A * 10/1967 Stewart ..... 213/1 R
3,587,868 A * 6/1971 Yates ..... 13/1 R
3,592,425 A * 7/1971 Randolph et al. ..... 248/53
3,784,030 A * 1/1974 Chierici ..... 213/76
4,986,500 A * 1/1991 Campbell ..... 248/53
6,568,649 B1 * 5/2003 Schmitt ..... 248/551
7,267,306 B2 * 9/2007 Eason et al. ..... 248/53
2003/0102415 A1 * 6/2003 Schmitt ..... 248/200
2007/0267377 A1 * 11/2007 McKiernan ..... 213/75 R

* cited by examiner

*Primary Examiner*—S. Joseph Morano
*Assistant Examiner*—Jason C Smith
(74) *Attorney, Agent, or Firm*—R. Neil Sudol; Henry D. Coleman; William J. Sapone.

(57) ABSTRACT

A trainline support bracket for connection to a railcar having a yoke and a coupler attached to the railcar and a coupler-uncoupling mechanism housing attached to the coupler having first and second side walls with first and second contoured recess members thereon, and having upper and lower compartments for attaching the trainline support bracket thereto. The trainline support bracket includes a main body connector having an upper connector section and a lower connector section. The upper connector section of the main body connector is for connecting to the coupler-uncoupling mechanism housing of the coupler. The trainline support bracket also includes a lower connecting bracket having a first end and a second end. The lower connector section of the main body connector is for detachably connecting to the first end of the lower connecting bracket; and the second end of the lower connecting bracket is for detachably connecting to a trainline fitting in order to support hose fittings, hoses and a gladhand coupling having a hose connected to the coupling.

27 Claims, 11 Drawing Sheets

TRAINLINE SUPPORT BRACKET

FIELD OF THE INVENTION

The present invention relates to a trainline support bracket for mounting a brake system hose, pipe and fitting line, commonly known as a trainline, to a railcar. More specifically, the trainline support bracket is intended for use on "cushioned cars".

BACKGROUND OF THE INVENTION

Cushioned cars are well-known in the prior art of railcars for trains. Cushioned cars may be of two types: the end of car cushioning type or the center of car cushioning type. End of car cushioning is a system whereby the couplers that connect one railcar to another are connected to spring and/or damper devices and therefore move relative to the railcars to produce a cushioning effect meant to protect the cargo in the railcars. Cars with center of car cushioning, also known as sliding sill cars, have a main structural sill that moves relative to the car body to allow travel of a spring and/or damper device.

While most railcars have some degree of cushioning, "cushioned cars" may have 10" to 20" of axial travel, while most cars have considerably less. Over the past few decades end of car cushioning has become more commonly used and the number of railcars in service with end of car cushioning continues to increase.

Standard railcar brake systems are pneumatically operated and each railcar has a trainline, which is the line through which air is fed from the locomotive to the first car, through to the next car, and so on to the end of the train. The trainline not only provides a means of feeding air to the individual brake systems of each car in the train, but also provides the means through which the engineer in the locomotive effects brake applications and brake releases. By use of a valve in the locomotive, the engineer raises and drops pressure in the trainline. Pneumatic logic valves, known as control valves, in each car respond to these changes in pressure by applying and releasing brake force.

The trainline of each car makes up a segment of the full trainline for the train. These trainline segments are then connected from car to car when a train is arranged. Each car must have means of supporting its own trainline segment, or trainline. One requirement of the supporting apparatus is to provide for the trainline segments of the cars to stay connected to each other as the cars go through various motions relative to each other as the train travels. This requirement has been a difficult challenge for the industry, especially when cushioned cars are used.

If the trainline support system is not adequately designed and applied, unintended hose separations can result. When the hoses separate, pressure drops in the trainline, which causes a full application of the brakes on all cars. Such events, which can cause operational delays, equipment damage and threats to safety, happen far too frequently in the industry and are a major area of attention for railroads and railcar owners. For this reason, the industry has been investing many millions of dollars each year in an effort to eliminate hose separations. One of the most commonly suspected reasons for hose separations is the motion of trainline components on a railcar relative to trainline components on the car to which such railcar is connected.

In addition to the costs and other problems of hose separations, the wide variety of trainline support systems has become a serious maintenance challenge for the industry. Equipment typically does not last for the full lifetime of the railcar and must be replaced occasionally due to age or damage. Ideal maintenance would require both availability of correct replacement equipment and knowledge of correct applications at repair locations dispersed around North America. Both of these requirements are very difficult challenges for the industry.

There remains a need for a novel and innovative trainline support system that can substantially reduce the hose separation challenge and the maintenance challenge that the railroad industry is facing. The present invention promises to reduce the variety of trainline support systems to less than 10% of the current variety. In addition, the trainline support system functions in such a way that much of the relative movement between trainline components during operation is eliminated.

DESCRIPTION OF THE PRIOR ART

Prior art trainline arrangements currently in use or introduced in the railroad industry can be classified as follows:

1) Attachment of the trainline to the railcar body:
   a) rigid bracket attachment (for example, AAR standards S424, S426); and
   b) floating attachment (for example, AAR standard S427).
2) Attachment of the trainline to the coupler yoke:
   a) rigid bracket attachment (for example, AAR standard S4021);
   b) limited horizontal rotation attachment (for example, AAR standard S4003); and
   c) hybrid-style (recently introduced, but not known to be in use).
3) Attachment of the trainline to the side of the coupler. (Obsolete due to problems).

Type 1a above may not adequately compensate for relative motion on some cars, may require wide variety of design geometries, and its performance is sensitive to application errors.

Type 1b above is suspected to contribute to hose separations because of several degrees of freedom, undesirable forces and motions transmitted through components of the system, likely interference with car components on some cars, and sensitivity to application errors. The high number of degrees of freedom makes performance difficult to predict.

Type 2a above is limited to use on cars with shorter couplers. Current designs only compensate for axial movement of the coupler, but not for rotation of the coupler relative to the car. The rigid design may also lead to kinking of hoses between cars and to difficulty coupling hoses when the train is on a curve.

Type 2b above compensates for axial motion of the coupler and attempts to compensate for rotational motion by allowing the trainline, in the form of a pipe in a pivoting channel, to swing from side to side as needed. This requires forces to be transmitted through the trainline hoses to move the pipe and channel, which is relatively heavy. The extra degrees of freedom relative to a rigid arrangement make performance difficult to predict.

Type 2c above was recently introduced by a supplier. The design combines a rigid bracket attached to the coupler yoke with a freely rotating bracket feature hanging from the end. This system is likely to have both the benefits and problems of other high degree of freedom systems.

Type 3 above was used briefly in the industry around 20-30 years ago. The angle cock valve of the trainline was attached to the side of the coupler by means of coupler mounting holes. It has been reported that this type of arrangement failed because the equipment would be and was torn off the coupler in the event of a bypassed coupler event, which is when a coupler on one car is misaligned with the coupler on the second car during coupling and the couplers slide alongside each other with tremendous force.

U.S. Pat. No. 6,568,649 to SCHMITT discloses a trainline support bracket and a fastener for mounting the bracket to a rail car coupler assembly which includes spaced, downwardly extending mounting extensions having aligned bores therein, with the bracket including a pair of upwardly extending arms, spaced apart a distance to be positioned directly outside of the mounting extension. This bracket attachment area shown is typical for many types 2 mentioned above and the specific bracket shown is for an arrangement of type 2b mentioned above. This prior art patent does not teach or disclose the structure, configuration and design of the trainline support bracket of the present invention. Most, if not all, the trainline systems currently in use fall clearly into one of the above classifications. Some slight variations exist, but they are not substantially different.

None of the prior art trainline arrangements, nor the prior art patents teach or disclose a trainline support bracket system that attaches to a coupler-uncoupling mechanism housing of a coupler in order to reduce movement of the trainline fittings and hoses relative to two adjacent couplers as claimed in the present invention.

Accordingly, it is an object of the present invention to provide a trainline support bracket that reduces the likelihood of a separation of a brakeline having a gladhand coupling.

Another object of the present invention is to provide a trainline support bracket that attaches to a coupler (instead of a yoke or car body) in order to reduce movement of the trainline fittings and hoses on one car relative to trainline fittings and hoses on an adjacent railcar.

Another object of the present invention is to provide a trainline support bracket that universally fits all railcar couplers in order to eliminate application variety that leads to high maintenance costs, incorrect applications, and separation of freight cars when the freight train is moving along the train track.

Another object of the present invention is to provide a trainline support bracket that attaches directly to a coupler-uncoupling mechanism housing of the coupler in which to have a brakeline support location that moves directly with the coupler such that the relative motion among components of the trainline support system and the couplers is dramatically reduced.

Another object of the present invention is to provide a trainline support bracket that reduces the movement of trainline components relative to each other.

Another object of the present invention is to provide a trainline support bracket that is made from steel, durable for heavy duty wear, easily installed and maintenance-free for long-lasting use.

A further object of the present invention is to provide a trainline support bracket that can be mass-produced in an automated and economical manner and is readily affordable by the railroad user.

SUMMARY OF THE INVENTION

In accordance with the present invention, there is provided a trainline support bracket for connection to a railcar having a yoke and a coupler attached to the railcar and a coupler-uncoupling mechanism housing attached to the coupler having first and second side walls with first and second contoured recess members thereon, and having upper and lower compartments for attaching the trainline support bracket thereto. The trainline support bracket includes a main body connector having an upper connector section and a lower connector section. The upper connector section of the main body connector is for connecting to the coupler-uncoupling mechanism housing of the coupler. The trainline support bracket also includes a lower connecting bracket having a first end and a second end. The lower connector section of the main body connector is for detachably connecting to the first end of the lower connecting bracket; and the second end of the lower connecting bracket is for detachably connecting to a trainline fitting in order to support hose fittings, hoses and a gladhand coupling having a hose connected to the coupling.

BRIEF DESCRIPTION OF THE DRAWINGS

Further objects, features and advantages of the present invention will become apparent upon the consideration of the following detailed description of the presently-preferred embodiment when taken in conjunction with the accompanying drawings, wherein.

DETAILED DESCRIPTION OF THE PREFERRED AND ALTERNATE EMBODIMENT

Preferred Embodiment 10

Figure 6:
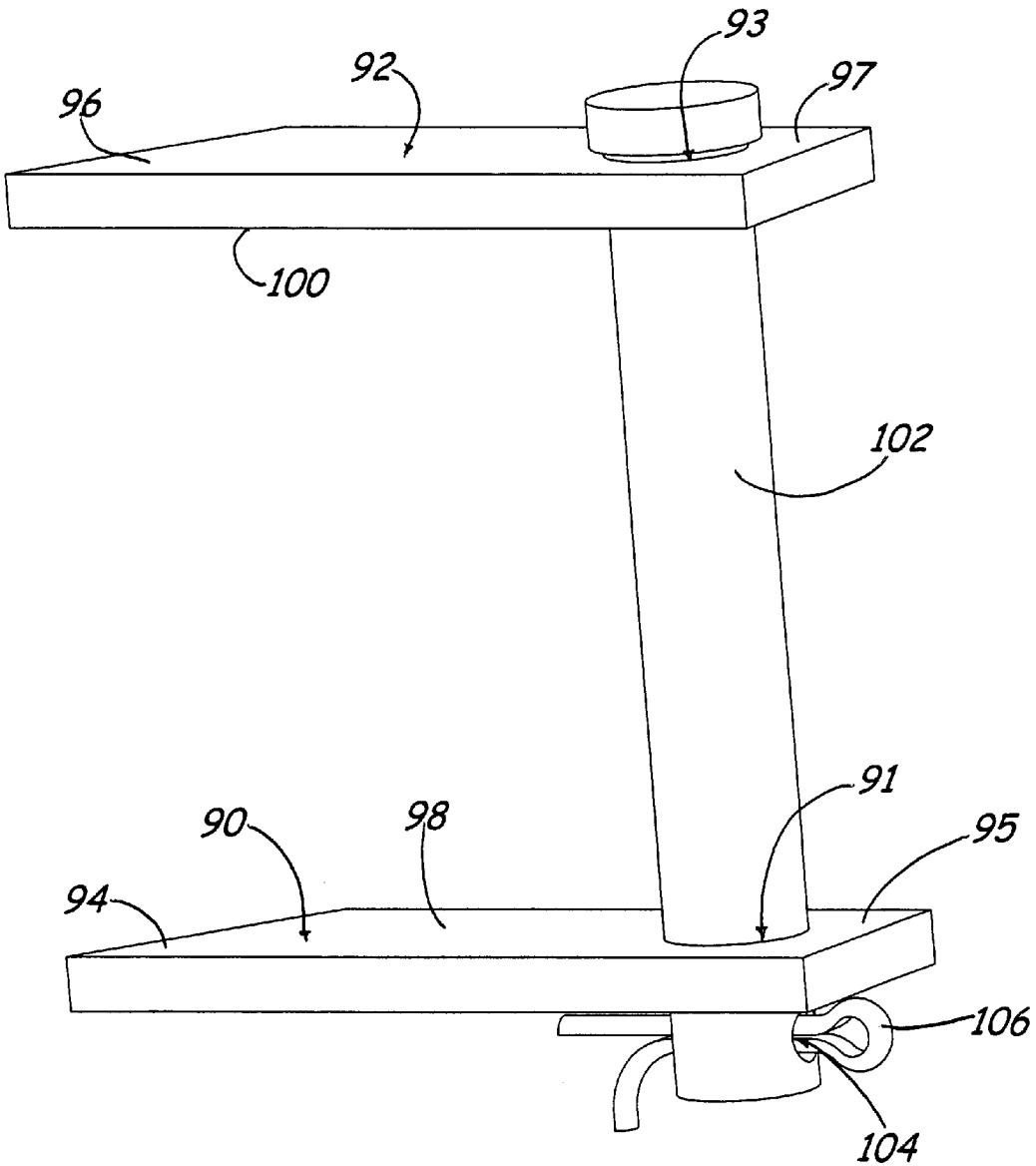
FIG. 6 is a perspective view of the trainline support bracket of the present invention showing a pair of clamping members each having a pin opening for receiving a holding pin therethrough.
Figure 7A:
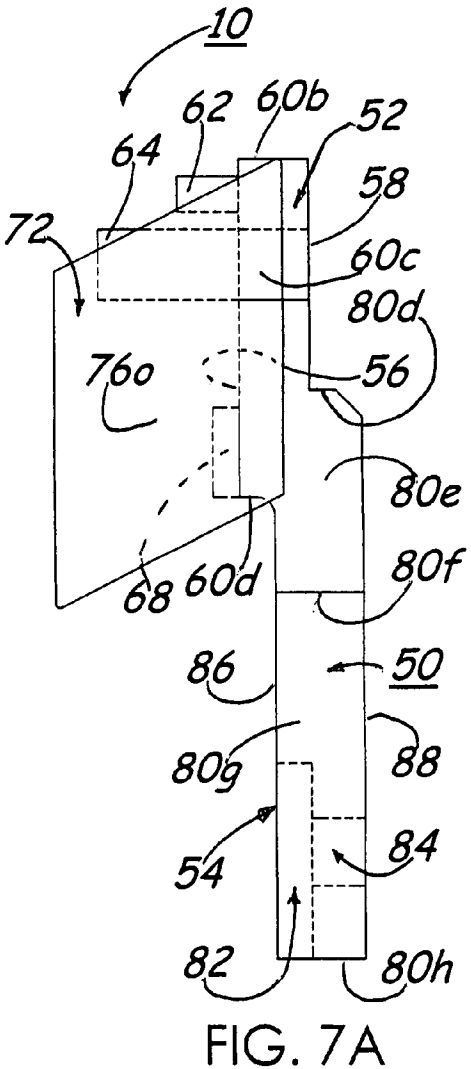
FIG. 7A is a side elevational view of the trainline support bracket of the present invention showing a main body connector having an upper connector section and a lower connector section.
Figure 7:
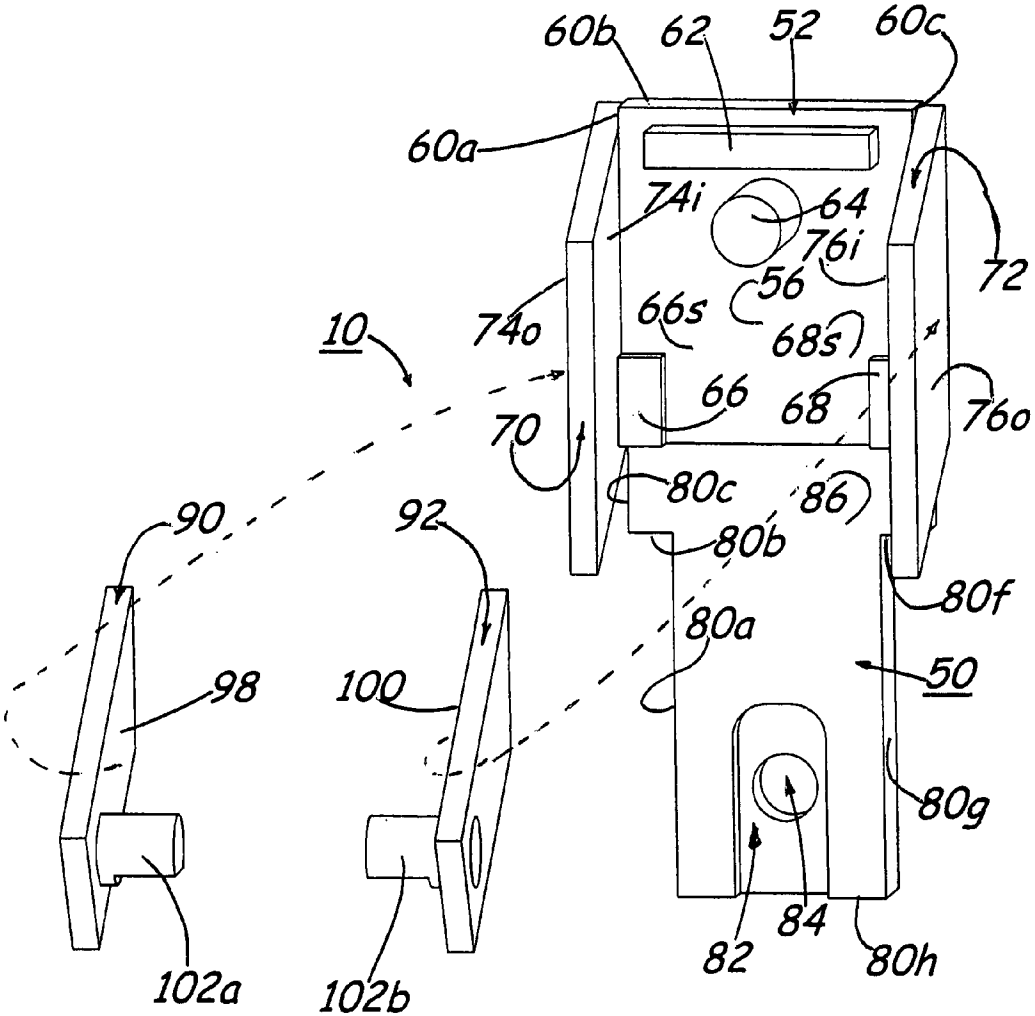
FIG. 7 is a front partially exploded perspective view of the trainline support bracket of the present invention showing the major component parts of the support bracket.
Figure 8:
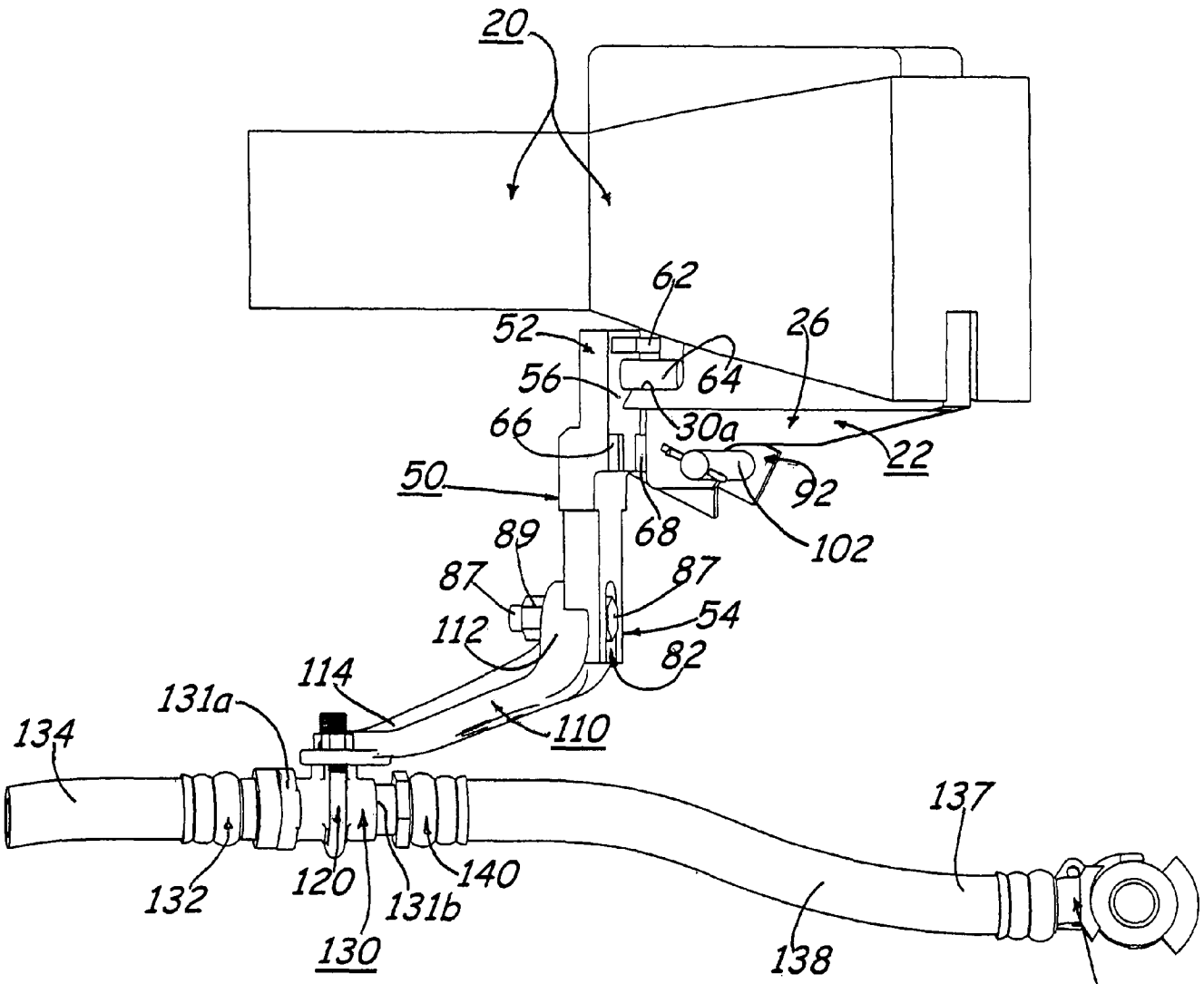
FIG. 8 is a partial perspective view of the trainline support bracket of the present invention showing a breakaway of only one side of the main body connector attached to the coupler in uncoupling mechanism housing.

The trainline support bracket 10 and its component parts of the preferred embodiment are represented in detail by FIGS. 1 through 8 of the patent drawings. The trainline support bracket 10 is used in conjunction with a railcar yoke 18 and a railcar coupler 20 having a coupler-uncoupling mechanism housing 22 thereon for preventing the brakeline hose separation on moving railcars, as shown in FIG. 8.

Figure 1:
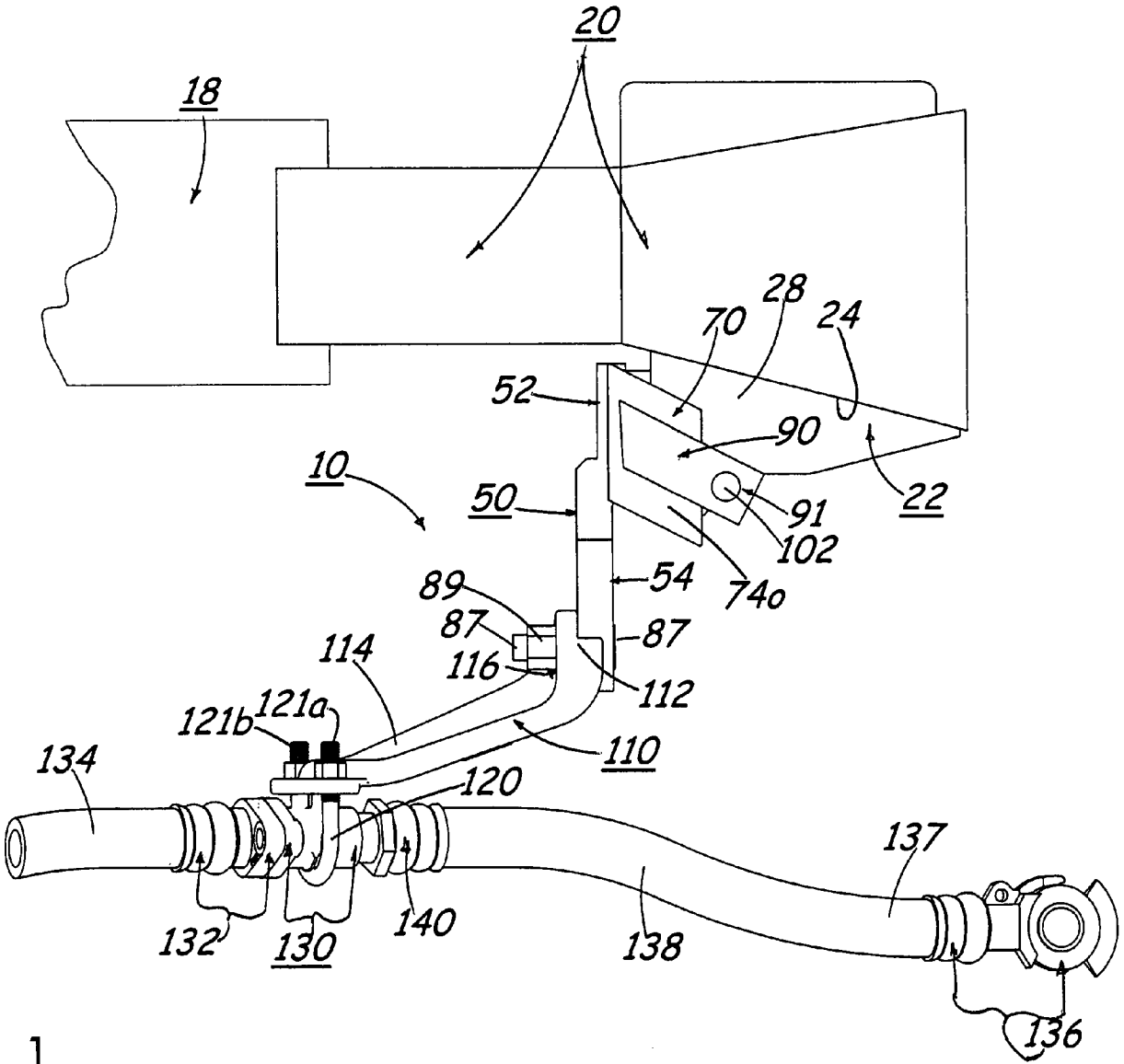
FIG. 1 is a perspective view of the trainline support bracket of the preferred embodiment of the present invention showing a railcar coupler and the mounting of the trainline support bracket thereto.
Figure 2:
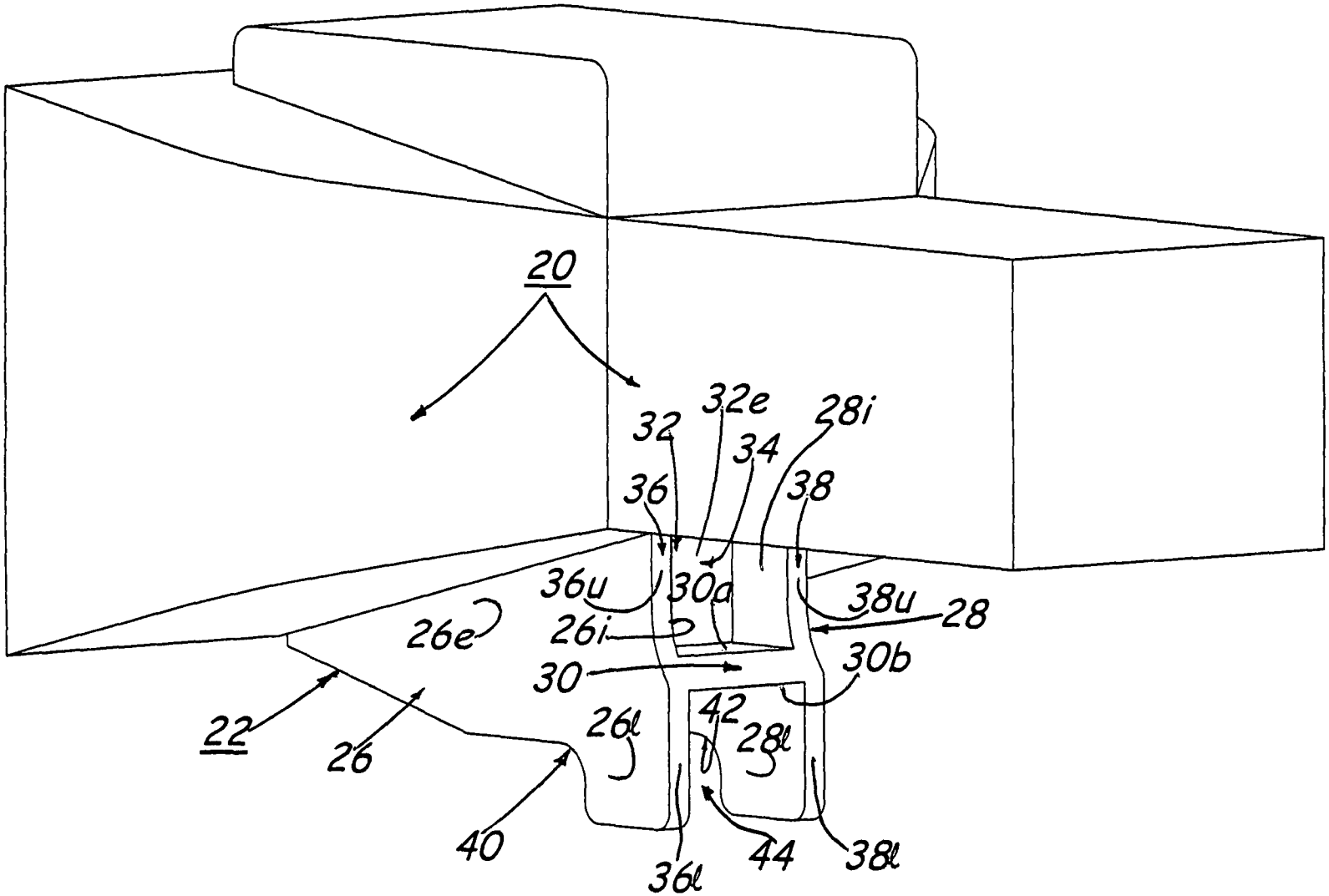
FIG. 2 is a perspective view of the trainline support bracket of the present invention showing the railcar coupler and the major component parts of a coupler-uncoupling mechanism housing thereto.
Figure 3:
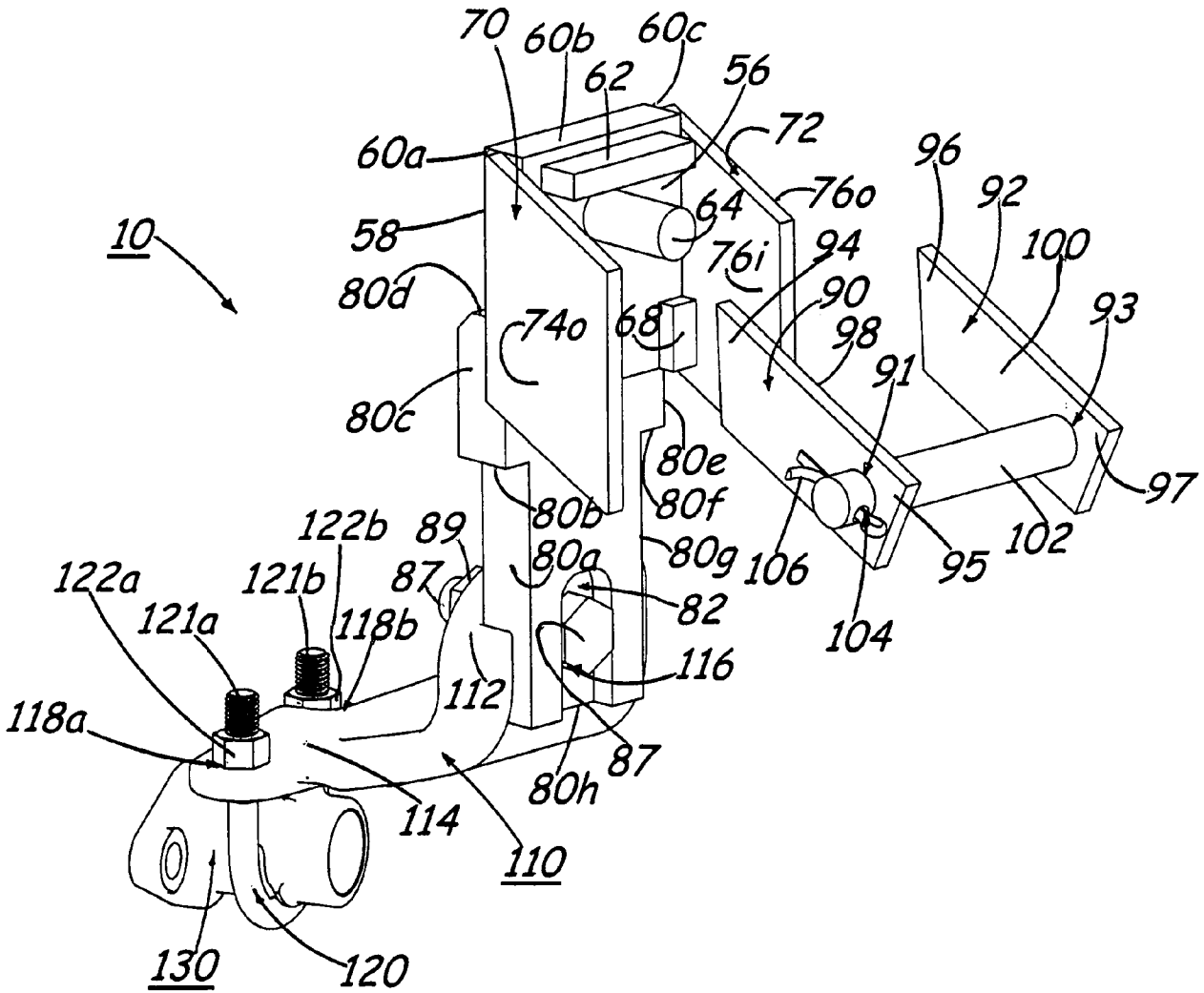
FIG. 3 is a perspective view of the trainline support bracket of the present invention showing the major component parts of the trainline support bracket thereof.

The coupler-uncoupling mechanism housing 22 extends downwardly from the railcar coupler 20 and is integrally attached to the railcar coupler 20, as depicted in FIGS. 1 and 2. The coupler-uncoupling mechanism housing 22 includes a coupler head bottom wall 24, a first side wall 26 having an exterior wall surface 26*e* and an interior wall surface 26*i* , a second side wall 28 having an exterior wall surface 28*e* and an interior wall surface 28*i* , an interior horizontal bottom wall 30 having an upper bottom wall surface 30*a* and a lower bottom wall surface 30*b*, and an interior vertical wall 32 having an exterior wall surface 32*e* for forming an upper housing compartment 34. The coupler-uncoupling mechanism housing 22 also includes a first perimeter edge 36 having an upper first perimeter edge 36*u* and a lower first perimeter edge 36*l*, a second perimeter edge 38 having an upper second perimeter edge 38*u* and a lower second perimeter edge 38*l*, a first contoured recess perimeter edge 40 and a second contoured recess perimeter edge 42. The coupler-uncoupling mechanism housing 22 further includes a lower housing compartment 44 formed by lower side walls 26*l* and 28*l* of side walls 26 and 28, respectively, and the horizontal bottom wall 30, as depicted in FIG. 2 of the drawings.

Figure 4:
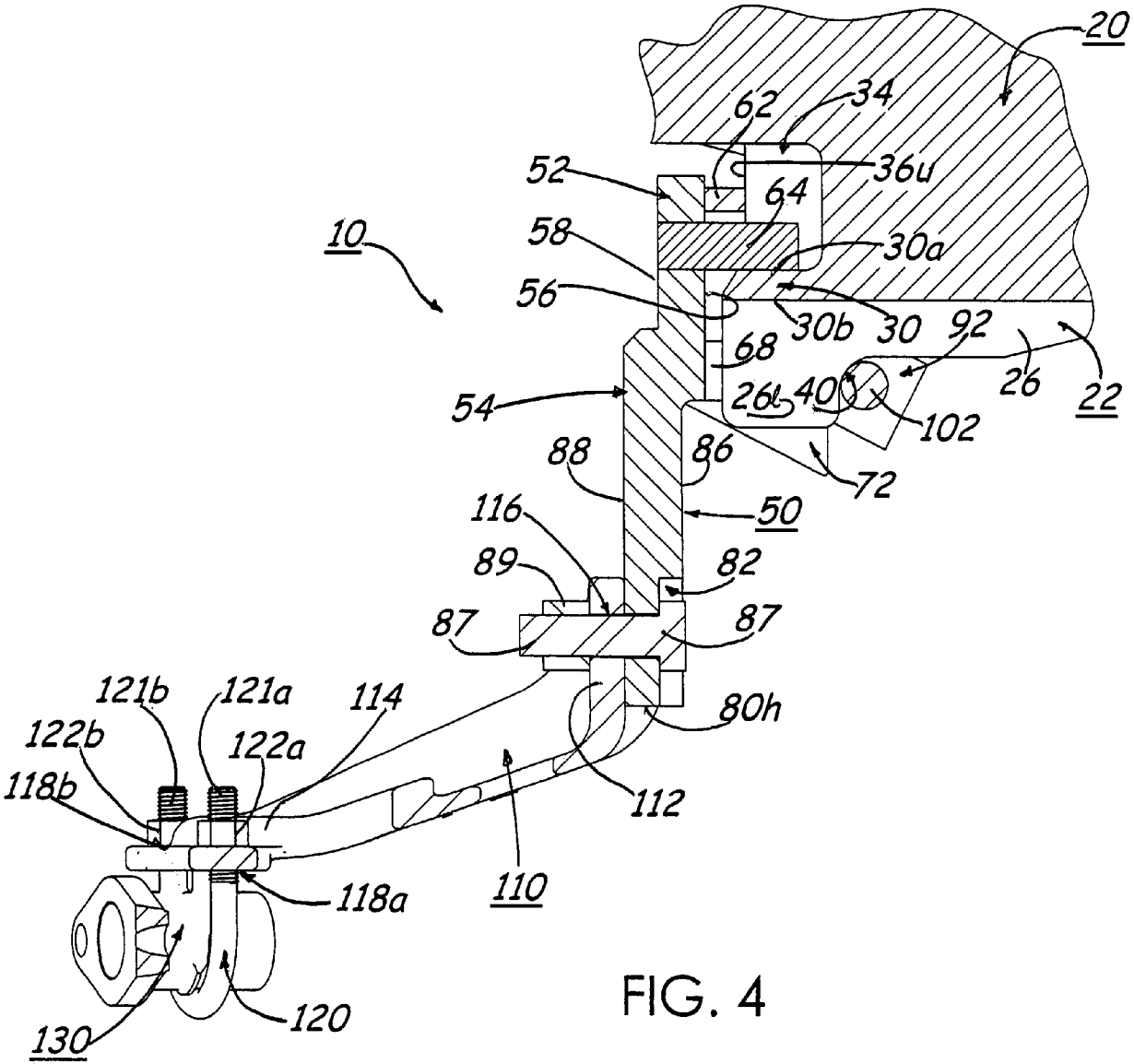
FIG. 4 is a cross-sectional view of the trainline support bracket of the present invention showing the trainline support bracket mounted to the coupler-uncoupling mechanism housing.

The coupler-uncoupling mechanism housing 22 is used for attaching the trainline support bracket 10 of the present invention to the railcar coupler 20, so that a main body connector 50 of the trainline support bracket 10 is supported on or suspended from the coupler 20, as shown in FIGS. 1 and 4 of the drawings. The trainline support bracket 10 includes a main body connector 50 having an upper connector section 52 and a lower connector section 54 being integrally connected with each other, as well as off-set from each other (see FIGS. 1 and 4). Main body connector 50 functions to provide the structural base for the upper functional elements that connect to the coupler 20 and the lower functional elements that connect to the trainline fittings 130, 132 and 136. The upper connector section 52 includes an upper/inner wall surface 56, an upper/outer wall surface 58 and perimeter edges 60*a*, 60*b*, 60*c* and 60*d*, respectively. The upper inner wall surface 56 of upper connector section 52 includes an upper contact pad 62 being centrally positioned on wall surface 56 and adjacent to perimeter edge 60*b*, and a holding extension pin or member 64 being centrally positioned on wall surface 56 and adjacent to the upper contact pad 62. The upper contact pad 62 functions to position the upper connector section 52 against the coupler 20 during installation and to bear forces transmitted through the trainline support system 10 during use. Holding extension pin 64 functions to allow the trainline support bracket 10 to be hung in place on the railcar coupler 20 during installation, leaving the installer's hands free to perform other requirements of the installation. The upper inner wall surface 56 of upper connector section 52 also includes a first lower contact pad 66 being adjacent to perimeter edges 60*a* and 60*d*, respectively, and a second lower contact pad 68 being adjacent to perimeter edges 60*c* and 60*d*, respectively. Each of the lower contact pads 66 and 68 are positioned on opposing sides 66*s* and 68*s* on wall surface 56, as shown in FIG. 7 of the drawings. Lower contact pads 66 and 68 function to position the main body connector 50 against the coupler 20 during installation and to bear forces transmitted through the trainline support system 10 during use. Each of the perimeter edges 60*a* and 60*c* include integrally attached (by welding) retaining walls 70 and 72 having inner and outer retaining wall surfaces 74*i* and 76*i*, 74*o* and 76*o*, respectively, as shown in FIGS. 7, 7A and 8. The retaining walls 70 and 72 have a substantially parallelogram-shape; or substantially rectangular-shape configuration.

Figure 5:
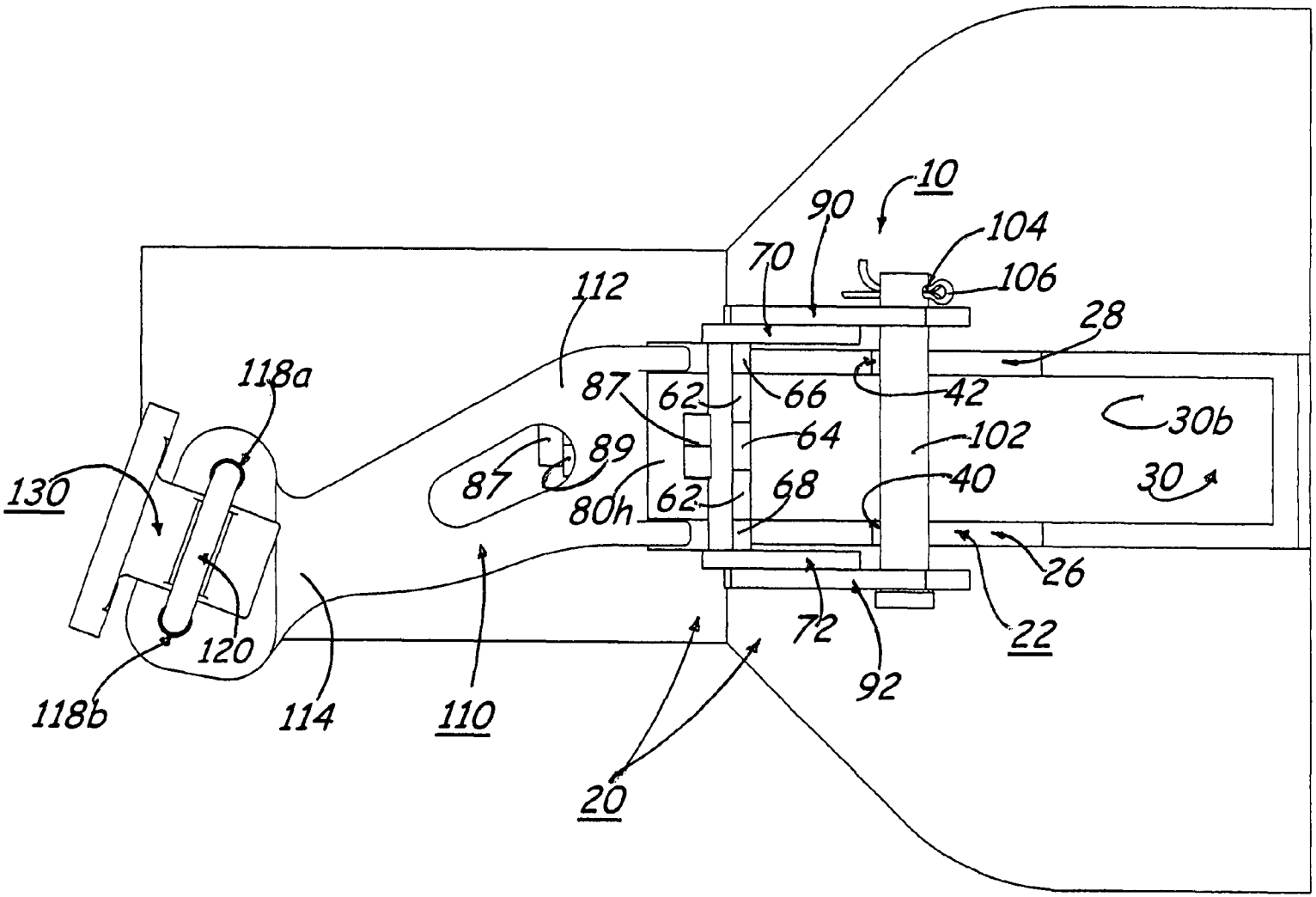
FIG. 5 is a bottom plan view of the trainline support bracket of the present invention showing the trainline support bracket mounted to the coupler-uncoupling mechanism housing.

The lower connector section 54 of the main body connector 50 includes a lower inner wall surface 86, a lower outer wall surface 88 and perimeter edges 80*a*, 80*b*, 80*c*, 80*d*, 80*e*, 80*f*, 80*g* and 80*h*, respectively. The lower connector section 54 is substantially T-shaped, as shown in FIGS. 5, 7 and 7A. The lower inner wall surface 86 of lower connector section 54 includes a recessed channel 82 having a bolt opening 84 for receiving a bolt member 87 and nut 89 therethrough.

The retaining walls 70 and 72 of the main body connector 50, as shown in FIG. 6, also include a pair of detachably connecting or fixedly attached clamping members 90 and 92 each having a pin opening 91 and 93 therethrough. Each of the clamping members 90 and 92 have a first end 94 and 96 and a second end 95 and 97. Each of the clamping members 90 and 92 has a clamping surface 98 and 100 at each of the first ends 94 and 96, respectively, for welding to each of the outer retaining wall surfaces 74*o* and 76*o* of retaining walls 70 and 72, respectively. Also, each of the second ends 95 and 97 of clamping members 90 and 92 include the pin openings 91 and 93 for receiving a retaining holding pin or device 102 therethrough having a cotter pin opening 104 for receiving a cotter pin 106 therethrough, as shown in FIGS. 7 and 8 of the drawings. The clamping members 90 and 92 and holding pin 102 act together in such a manner, when positioned properly against the railcar coupler 20 and welded to the bracket retaining walls 70 and 72, to hold the trainline support bracket 10 securely on the railcar coupler 20 and to provide a means, i.e., by removing holding pin 102, of removing the trainline support bracket 10 from the railcar coupler 20. Alternatively, as shown in FIG. 7, retaining holding pin 102 is replaced by two separate side holding pins or devices 102*a* and 102*b*. In this alternative, pin openings 91 and 93 receive pins 102*a* and 102*b* respectively. Holding pins 102*a* and 102*b* are fixedly attached to clamping members 90 and 92, respectively, by welding or some other means.

As shown in FIGS. 1 and 8, the trainline support bracket 10 also includes a detachably connected lower connecting bracket 110 for connecting between the lower connector section 54 of the main body connector 50 and a trainline fitting 130 for supporting an intermediate hose fitting 132 and a gladhand coupling 136 having hoses 134 and 138, respectively thereon. The lower connecting bracket 110 includes a first end 112 and a second end 114. The first end 112 of lower connecting bracket 110 includes a bolt opening 116 for receiving the bolt member 87 therethrough. Bolt openings 84 and 116 are aligned, in contact and adjacent with each other for receiving bolt member 87 therethrough in order to detachably connect the train support bracket 10 to the lower connecting bracket 110, as shown in FIGS. 1, 4, 5 and 8 of the patent drawings. The second end 114 of lower connecting bracket 110 includes a pair of opposing bolt openings 118*a* and 118*b* for receiving the threaded ends 121*a* and 121*b* of U-bolt 120. U-bolt 120 is locked in place about the trainline fitting 130 using U-bolt nuts 122*a* and 122*b* on threaded ends 121*a* and 121*b* of U-bolt 120, respectively, as depicted in FIG. 4 of the drawings.

The trainline fitting 130 has a first end 131*a* and a second end 131*b*, such that the first end 131*a* of trainline fitting 130 is detachably connected to an intermediate hose fitting 132 having a hose 134 thereon. The second end 131*b* of the trainline fitting 130 is detachably connected to an end hose fitting 140 having a hose 138 thereon. Hose 138 at its other end 137 includes a gladhand coupling 136, as depicted in FIG. 1 of the drawings.

First Alternate Embodiment 200

Figure 9:
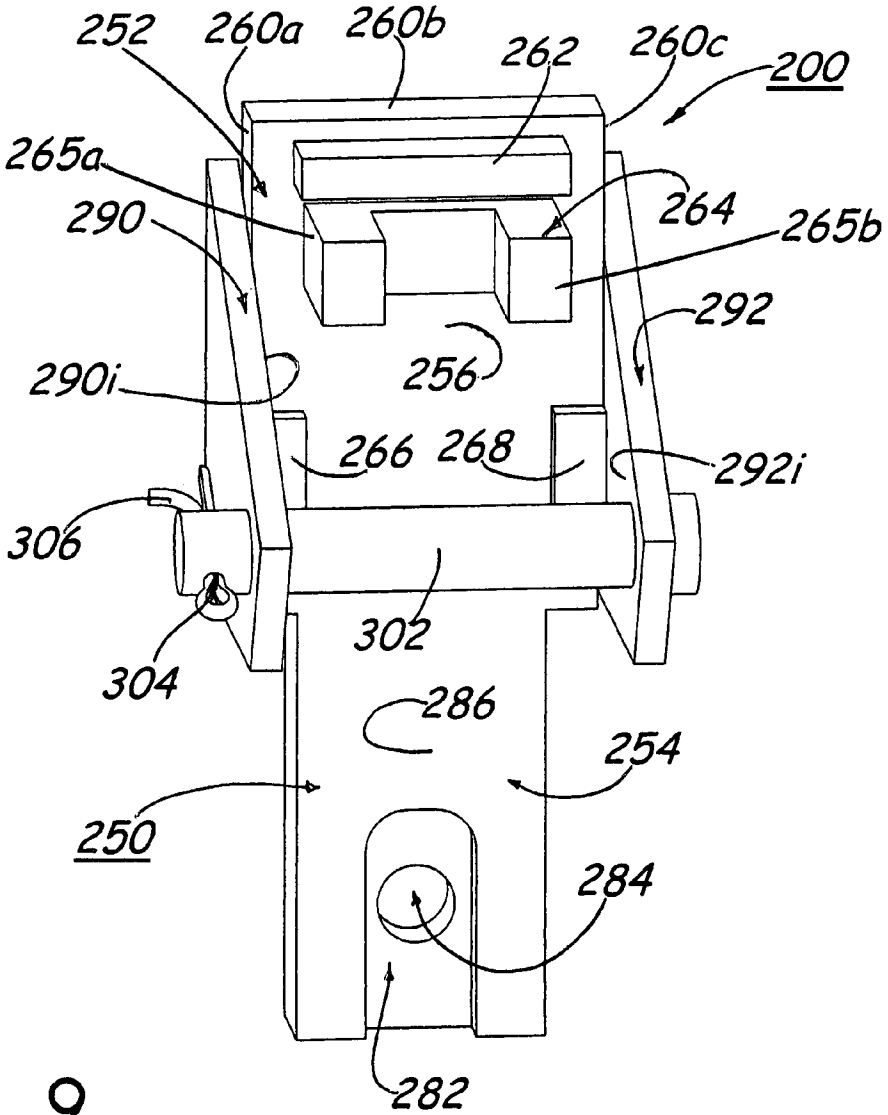
FIG. 9 is a front perspective view of the trainline support bracket of the first alternate embodiment of the present invention showing the major component parts of the alternate design of the support bracket.

The trainline support bracket 200 and its component parts of the first alternate embodiment of the present invention is represented in detail by FIG. 9 of the patent drawings. Elements illustrated in FIG. 9 which correspond to the elements described above with reference to FIGS. 1 through 8, have been designated by corresponding reference numbers increased by two hundred. The first alternate embodiment 200 is similarly constructed and operates in the same manner as the preferred embodiment 10, unless it is otherwise stated.

All aspects of the first alternate embodiment of the trainline support bracket 200 are the same as the preferred embodiment of the trainline support bracket 10 except for a U-shaped holding extension bar or member 264 having opposing contact extension blocks 265*a* and 265*b* being centrally positioned on wall surface 256 adjacent to the upper contact pad 262 of the upper connector section 252 of the main body connector 250. The opposing extension blocks 265*a* and 265*b* of U-shaped holding extension bar 264 contact the upper bottom wall surface 230*a* of horizontal wall 230 and function to support the weight of trainline support bracket 200, and the opposing extension blocks 265*a* and 265*b* are also adjacent (but not in contact) to interior side walls 226*i* and 228*i* of sidewalls 226 and 228, respectively, of housing 222. Additionally, the upper connector section 252 of the main body connector 250 includes opposing clamping members 290 and 292 fixedly attached by welding to perimeter edges 260*a* and 260*c*, respectively, at the time of installation. Thus, eliminating the need for retaining walls 70 and 72 (see FIG. 7 of the preferred embodiment) being attached to perimeter edges 60*a* and 60*c* of the preferred embodiment, respectively. In this manner, the interior wall surfaces 290*i* and 292*i* of clamping members 290 and 292 are in contact with and adjacent to the lower side walls 226*l* and 228*l* of side walls 226 and 228 of the coupler-uncoupling mechanism housing 222, respectively.

In all other respects, the trainline support bracket of the first alternate embodiment 200 is exactly the same as the trainline support bracket of the preferred embodiment 10, except for the structural configuration of the holding extension bar 264 being U-shaped instead of a cylindrical pin-shape (see extension pin 64 on FIG. 7) in the preferred embodiment 10, as well as the opposing retaining walls 70 and 72 of the preferred embodiment 10 being replaced by the opposing clamping members 290 and 292 of the alternate embodiment 200, respectfully, as shown in FIG. 9 of the drawings.

Second Alternate Embodiment 400

Figure 10:
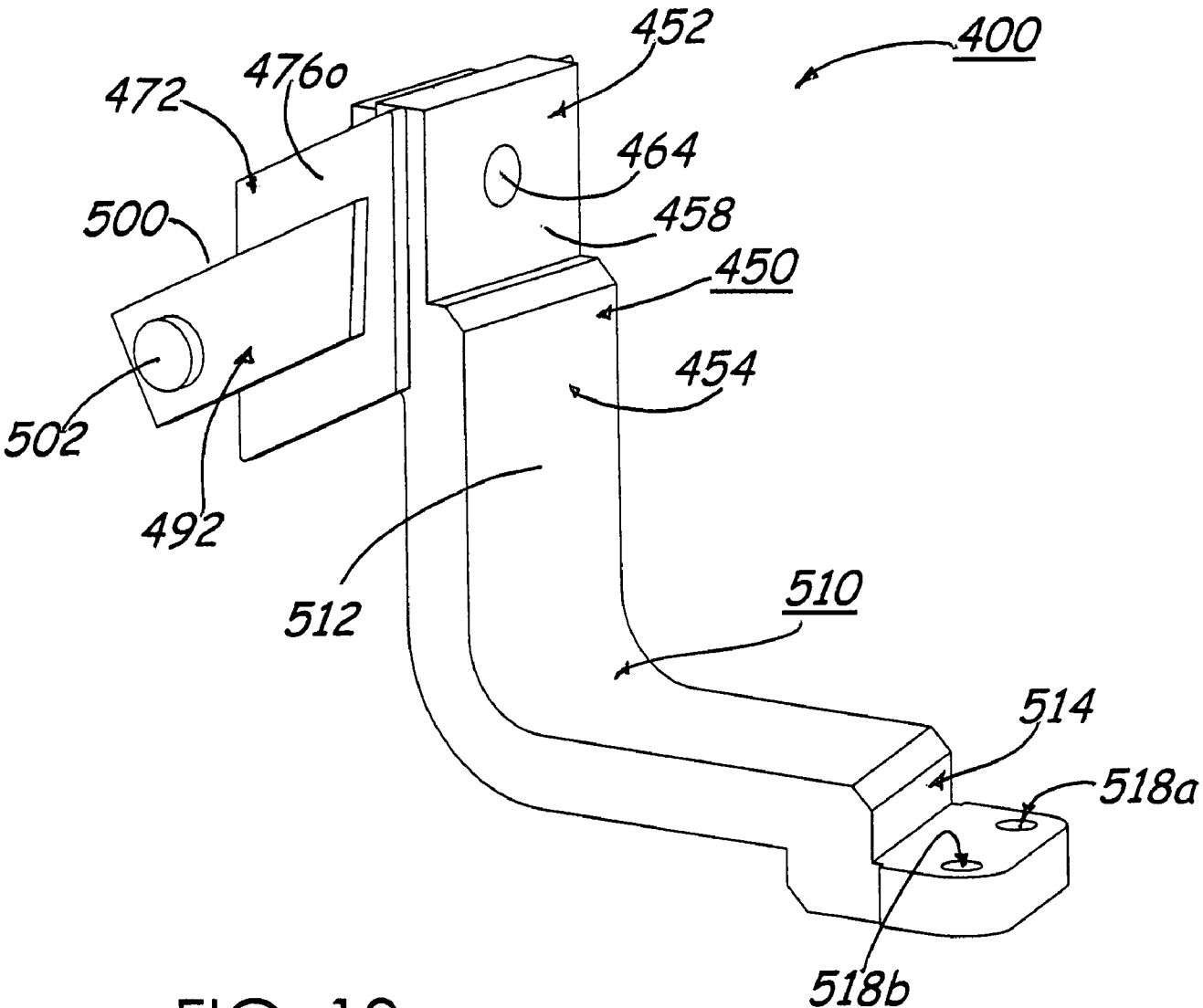
FIG. 10 is a perspective view of the trainline support bracket of the second alternate embodiment of the present invention showing the major component parts of the main body connector being integrally connected to the lower connecting bracket.

The trainline support bracket 400 and its component parts of the second alternate embodiment of the present invention is represented in detail by FIG. 10 of the patent drawings. Elements illustrated in FIG. 10 which correspond to the elements described above with reference to FIGS. 1 through 8 have been designated by corresponding reference numbers increased by four hundred. The second alternate embodiment 400 is similarly constructed and operates in the same manner as the preferred embodiment 10, unless it is otherwise stated.

All aspects of the second alternate embodiment of the trainline support bracket 400 are the same as the preferred embodiment of the trainline support bracket 10 except for the integration of the first end 512 of the lower connecting bracket 510 as an integral unit with the lower connector section 454 of the main body connector 450 (see FIG. 10). The trainline support bracket 400, as depicted in FIG. 10, now has an L-shaped configuration. The aforementioned unitary constructed trainline support bracket 400, has now eliminated the need for the lower connector section 450 having the recessed channel 82 with the bolt opening 84 for receiving the bolt member 87 and nut 89 therethrough for connecting to the first end 112 of the lower connecting bracket 110, as shown in FIGS. 1 and 8 of the preferred embodiment.

In all other respects, the trainline support bracket of the second alternate embodiment 400 is exactly the same as the trainline support bracket of the preferred embodiment 10, except for the L-shaped structural configuration of the single unitary constructed trainline support bracket 400 having the lower connector section 454 of the main body connector 450 and the first end 512 of the lower connecting bracket 510 as an integrally connected single piece (see FIG. 10).

Operation of the Present Invention

As shown in FIGS. 1, 2, 4, 5, 5A and 8, the trainline support bracket 10 in conjunction with the coupler-uncoupling mechanism housing 22 of coupler 20 and the lower connection bracket 10 operates in the following manner: the railroad maintenance crew initially inserts and places the holding extension pin 64 of the upper connector section 52 of main body connector 50 on the upper bottom wall surface 30*a* of interior horizontal bottom wall 30 within the upper housing compartment 34, as depicted in FIG. 4 of the drawings. The holding extension pin 64 limits the downward movement of the trainline support bracket 10 during the installation phase and also limits the lateral rotation and downward movement of the trainline support bracket 10 during actual operational use, as shown in FIG. 1 of the drawings.

Figure 5A:
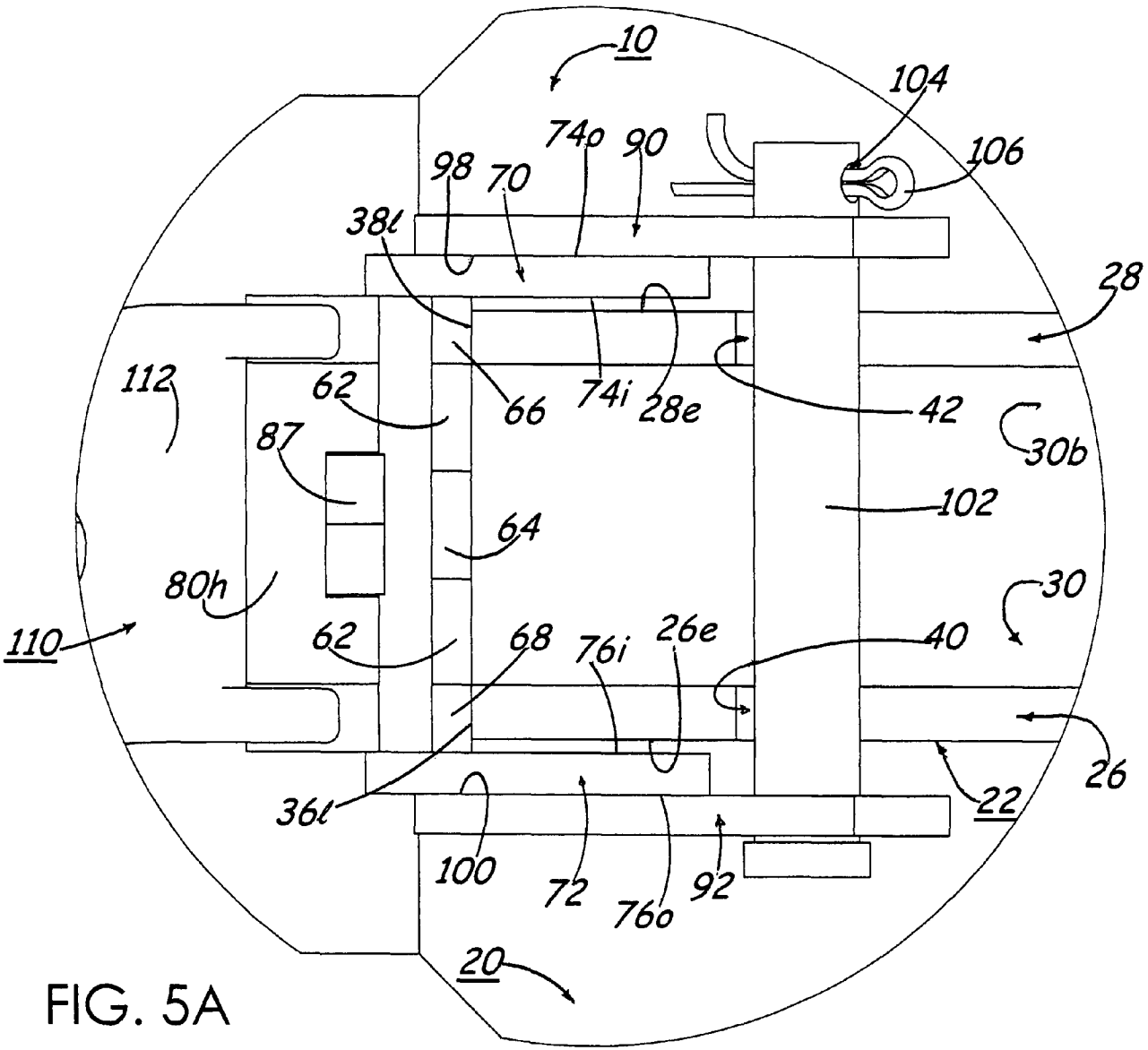
FIG. 5A is an enlarged bottom plan view of the trainline support bracket of the present invention showing the trainline support bracket mounted to the coupler-uncoupling mechanism housing.

The installer now positions each of the lower contact pads 66 and 68 on wall surface 56 adjacent to and in contact with each of the lower perimeter edges 36*l* and 38*l* of perimeter edges 36 and 38, respectively, of the first and second side walls 26 and 28 of the coupler-uncoupling mechanism housing 22, respectively, as depicted in FIGS. 4, 5 and 5A of the drawings. During operational use each of the lower contact pads 66 and 68 limit the rotational and horizontal movement of the trainline support bracket 10. Simultaneously, the installer now positions the upper contact pad 62 on wall surface 56 adjacent to and in contact with each of the upper perimeter edges 36*u* and 38*u* of perimeter edges 36 and 38, respectively, of the first and second side walls 26 and 28 of the coupler-uncoupling mechanism housing 22, respectively, as shown in FIGS. 4 and 8 of the drawings. During operational use, the upper contact pad 62 also limits the rotational and horizontal movement of the trainline support bracket 10.

The installer now proceeds to position, as shown in FIG. 5A, each of the inner retaining wall surfaces 741 and 761 of retaining walls 70 and 72 on the upper connector section 52 adjacent to and outside (not in contact) of each of the exterior wall surfaces 26*e* and 28*e* of side walls 26 and 28 on housing 22, respectively. Again, during operational use, the retaining walls 70 and 72 limit the horizontal movement, and may also limit the rotation of the trainline support bracket 10 of the moving railcars. The aforementioned three steps all occur simultaneously by the installer.

In the next step, the installer now places and positions (see FIGS. 3 through 7) the assembled clamping members 90 and 92 having the retaining holding pin 102 in position with cotter pin 106 locked in place such that clamping surfaces 98 and 100 of clamping members 90 and 92, respectively, are adjacent to and contact with each of the outer retaining wall surfaces 74*o* and 76*o* of retaining walls 70 and 72, respectively. The installer then further positions the retaining holding pin 102 within each of the first and second contoured recess perimeter edges 40 and 42 on side walls 26 and 28, respectively, where then the clamping surfaces 98 and 100 of clamping members 90 and 92 are fixedly attached by welding to the outer retaining wall surfaces 74*o* and 76*o* of retaining walls 70 and 72, respectively. During operational use, the retaining holding pin 102 also limits the vertical, horizontal and rotational movement of the trainline support bracket 10. When removing the trainline support bracket 10 from coupler 20, the installer simply removes cotter pin 106 from cotter pin opening 104 and removes the retaining holding pin 102 from pin openings 91 and 93, respectively, in order to dislodge the trainline support bracket 10 from coupler 20.

The next step has the installer connecting the first end 112 of the lower connecting bracket 110 to the lower connector section 54 of the main body connector 50, as depicted in FIG. 5. The installer aligns the pin opening 116 of the first end 112 with the pin opening 84 on recessed channel 82 such that pin openings 84 and 116 are adjacent to and in contact with each other for receiving bolt member 87 and nut 89 therethrough in order to detachably connect the trainline support bracket 10 to the lower connecting bracket 110, as shown in FIGS. 1, 4, 5 and 8 of the patent drawings. The installer now connects the second end 114 of the lower connecting bracket 110 to the U-bolt 120 for locking in place the trainline fitting 130. The installer simply places the U-bolt 120 around the trainline fitting 130 (see FIGS. 3 and 4) and inserts the threaded ends 121*a* and 121*b* of U-bolt 120 into opposing bolt openings 118*a* and 118*b* of second end 114, respectively, then using U-bolt nuts 122*a* and 122*b* to lock the U-bolt 120 in place about the trainline fitting 130.

In the last step, the installer now detachably connects the first end 131*a* of trainline fitting 130 with the intermediate hose fitting 132 having hose 134 thereon; and detachably connects the second end 131*b* of trainline fitting 130 with the end hose fitting 140 having hose 138 thereon. Hose 138 at its other end 137 has the gladhand coupling 136 in place for attaching to an adjacent gladhand coupling 136 of another railcar, as shown in FIG. 8.

Advantages of the Present Invention

Accordingly, an advantage of the present invention is that it provides for a trainline support bracket that reduces the likelihood of a separation of a brakeline having a gladhand coupling.

Another advantage of the present invention is that it provides for a trainline support bracket that attaches to a coupler (instead of a yoke or a car body) in order to reduce movement of the trainline fittings and hoses on one car relative to trainline fittings and hoses on an adjacent railcar.

Another advantage of the present invention is that it provides for a trainline support bracket that universally fits all railcar couplers in order to eliminate application variety that leads to high maintenance costs, incorrect applications, and separation of freight cars when the freight train is moving along the train track.

Another advantage of the present invention is that it provides for a trainline support bracket that attaches directly to a coupler-uncoupling mechanism housing of the coupler in which to have a brakeline support location that moves directly with the coupler such that the relative motion among components of the trainline support system and the couplers is dramatically reduced.

Another advantage of the present invention is that it provides for a trainline support bracket that reduces the movement of trainline components relative to each other.

Another advantage of the present invention is that it provides for a trainline support bracket that is made from steel, durable for heavy duty wear, easily installed and maintenance-free for long-lasting use.

A further advantage of the present invention is that it provides for a trainline support bracket that can be mass-produced in an automated and economical manner and is readily affordable by the railroad user.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed:

1. A trainline support bracket for connection to a railcar having a yoke and a coupler attached to a railcar and an uncoupling mechanism housing attached to the coupler having first and second side walls with first and second contoured recess members thereon, and having upper and lower compartments, comprising:

a) trainline support bracket including a main body connector having an upper connector section and a lower connector section, said upper connector section of said main body connector configured to substantially rigidly connect said trainline support bracket to the uncoupling mechanism housing of the coupler;

b) a lower connecting bracket having a first end and a second end;

c) said lower connector section of said main body connector for detachably connecting to said first end of said lower connecting bracket; and d) said second end of said lower connecting bracket for detachably connecting to a trainline fitting in order to support hose fittings, hoses and a gladhand coupling having a hose connected to the coupling, said upper connecting section of said main body connector including a primary locator with three contacts engageable with the uncoupling mechanism housing of the coupler, a secondary locator with two contacts engageable with the uncoupling mechanism housing of the coupler, and a tertiary connector with one contact engageable with the uncoupling mechanism housing of the coupler, said primary locator, said secondary locator and said tertiary locator being configured to limit translation motion of said main body connector relative to the uncoupling mechanism housing of the coupler in respective non-parallel directions.

2. A trainline support bracket in accordance with claim 1, wherein said lower connector section includes a lower inner wall, and wherein said lower inner wall includes a recessed channel having a connector bolt opening for receiving a bolt member and nut therethrough; and wherein said first end of said lower connecting bracket includes a lower bracket bolt opening, such that said connector bolt opening and said lower bracket bolt opening are aligned and in contact with each other for receiving said bolt member therethrough in order to detachably connect said trainline support bracket to said lower connecting bracket.

3. A trainline support bracket in accordance with claim 1, wherein said second end of said lower connecting bracket includes a pair of opposing bolt openings for receiving a U-bolt member therethrough, said U-bolt member for detachably connecting to said trainline fitting.

4. A trainline support bracket in accordance with claim 1, further comprising a clamping system having a first clamping member and a second clamping member, each of said first and second clamping members including a first end and a second end, wherein said first and second clamping members are positioned on opposing sides of said main wall or plate; and wherein said first and second clamping surfaces of said first and second clamping members at each of said first ends, respectively, are adjacent to and outside of the first and second side walls of the uncoupling mechanism housing; and said first and second clamping members are positioned in engagement with respective ones of the first and second contoured recess members of the first and second side walls, respectively, of the uncoupling mechanism housing such that said clamping system limits the vertical, horizontal and rotational movements of said trainline support bracket during operational use thereof.

5. A trainline support bracket in accordance with claim 1 wherein said primary locator includes three contact pads engageable with the uncoupling mechanism housing of the coupler and limiting translation motion in a first direction and rotational motion about at least one first axis, said secondary locator including a first retaining wall and an opposing second retaining wall respectively engageable with said first and second side walls of the uncoupling mechanism housing and limiting translation motion in a second direction and rotational motion about at least one second axis, said tertiary locator including a single element engageable with the uncoupling mechanism housing of the coupler and limiting translation motion in a third direction.

6. A trainline support bracket in accordance with claim 5, wherein said upper connector section on said main body connector includes a U-shaped member having an inner wall, and an upper contact pad mounted thereon;

wherein said upper contact pad is in contact with the upper compartment of the uncoupling mechanism housing such that said upper contact pad limits the rotational and horizontal movements of said trainline support bracket during operational use thereof; and wherein said U-shaped member includes a first retaining wall and a second retaining wall extending from opposing sides or edges of said inner wall, said surfaces being surfaces of said first retaining wall and said second retaining wall, respectively.

7. A trainline support bracket in accordance with claim 6, wherein said inner wall of said U-shaped member of said upper connector section has mounted thereon a holding extension member; and wherein said holding extension member is in contact with the upper compartment of the uncoupling mechanism housing such that said holding extension member during installation limits the downward movement of said trainline support bracket and during operational use also limits the lateral rotation and downward movements of said trainline support bracket.

8. A trainline support bracket in accordance with claim 6, wherein said inner wall of said U-shaped member of said upper connector section includes a first lower contact pad and a second lower contact pad;

each of said first and second lower contact pads being positioned on opposing sides of said inner wall; and wherein each of said first and second lower contact pads is adjacent to and in contact with the lower compartment of the uncoupling mechanism housing such that each of said first and second contact pads limit the rotational and horizontal movements of said trainline support bracket during operational use thereof.

9. A trainline support bracket in accordance with claim 6, wherein said first and second retaining walls are adjacent to and outside of the first and second side walls of the uncoupling mechanism housing such that said first and second retaining walls limit the horizontal and rotational movements of said trainline support bracket of moving railcars during operational use thereof.

10. A trainline support bracket in accordance with claim 9, wherein each of said first and second retaining walls of said U-shaped member of said upper connector section includes a clamping system having a first clamping member and a second clamping member, each of said first and second clamping members including a first end and a second end; and wherein each of said first ends of said first and second clamping members include first and second clamping surfaces, respectively, and each of said second ends of said first and second clamping members include first and second openings, respectively, for receiving a retaining device therethrough.

11. A trainline support bracket in accordance with claim 10, wherein each of said first and second clamping surfaces of said first and second clamping members at each of said first ends, respectively, are attached to each of said first and second retaining walls, respectively, on said U-shaped member; and wherein said retaining device is positioned on each of the first and second contoured recess members of the first and second side walls, respectively, of the uncoupling mechanism housing such that said clamping system limits the vertical, horizontal and rotational movements of said trainline support bracket during operational use thereof.

12. A trainline support bracket in accordance with claim 10, wherein each of said first and second clamping members are positioned on opposing sides of said inner wall; and wherein each of said first and second clamping surfaces of said first and second clamping members at each of said first ends, respectively, of said U-shaped member are adjacent to and outside of the first and second side walls of the coupling-uncoupling mechanism housing; and said retaining device is positioned on each of the first and second contoured recess members of the first and second side walls, respectively, of the uncoupling mechanism housing such that said clamping system limits the vertical, horizontal and rotational movements of said trainline support bracket during operational use thereof.

13. A trainline support bracket for connection to a railcar having a yoke and a coupler attached to the railcar and an uncoupling mechanism housing attached to the coupler having first and second side walls with first and second contoured recess members thereon, and having upper and lower compartments, comprising:

a) a trainline support bracket including a main body connector having an upper connector section and a lower connector section, said upper connector section of said main body connector including components for substantially rigidly connecting to the uncoupling mechanism housing of the coupler;

b) said lower connector section having a first end; and c) said first end of said lower connector section for detachably connecting to a trainline fitting in order to support hose fittings, hoses and a gladhand coupling having a hose connected to the coupling, wherein said components of said upper connector section include a main wall or plate that contacts said first and second side walls of said uncoupling mechanism housing, said components of said upper connector section further including a pair of mutually spaced and substantially parallel side walls or plates connected to said main wall on a common side thereof and oriented substantially perpendicularly to said main wall or plate.

14. A trainline support bracket in accordance with claim 13, wherein said upper connector section on said main body connector further includes an upper contact pad mounted on said main wall or plate and between said mutually spaced and substantially parallel side walls or plates and wherein said upper contact pad is in contact with the upper compartment of the uncoupling mechanism housing such that said upper contact pad limits the rotational and horizontal movements, of said trainline support bracket during operational use thereof.

15. A trainline support bracket in accordance with claim 14, wherein said main wall or plate of said upper connector section has mounted thereon a holding extension member; and wherein said holding extension member is in contact with the upper compartment of the uncoupling mechanism housing such that said holding extension member during installation limits the downward movement of said trainline support bracket and during operational use also limits the lateral rotation and downward movements of said trainline support bracket.

16. A trainline support bracket in accordance with claim 14, wherein said main wall or plate of said upper connector section includes a first lower contact pad and a second lower contact pad positioned on opposing sides of said main wall or plate; and wherein each of said first and second lower contact pads is adjacent to and in contact with the lower compartment of the uncoupling mechanism housing such that each of said first and second contact pads limits the rotational and horizontal movements of said trainline support bracket during operational use thereof.

17. A trainline support bracket in accordance with claim 14, wherein said mutually spaced and substantially parallel side walls or plates are a first retaining wall and a second retaining wall positioned on opposing sides of said main wall or plate; and wherein said first and second retaining walls are adjacent to and outside of respective ones of the first and second side walls of the uncoupling mechanism housing such that said first and second retaining walls limit the horizontal and rotational movements of said trainline support bracket of moving railcars during operational use thereof.

18. A trainline support bracket in accordance with claim 17, wherein each of said first and second retaining walls of said U-shaped member of said upper connector section includes a clamping system having a first clamping member and a second clamping member, each of said first and second clamping members including a first end and a second end; and wherein each of said first ends of said first and second clamping members includes first and second clamping surfaces, respectively, and each of said second ends of said first and second clamping members includes first and second pin openings, respectively, for receiving a retaining device therethrough.

19. A trainline support bracket in accordance with claim 18, wherein each of said first and second clamping surfaces of said first and second clamping members at each of said first ends, respectively, is attached to each of said first and second retaining walls, respectively; and wherein said retaining device is positioned on each of the first and second contoured recess members of the first and second side walls, respectively, of the uncoupling mechanism housing such that said clamping system limits the vertical, horizontal and rotational movements of said trainline support bracket during operational use thereof.

20. A trainline support bracket in accordance with claim 13, wherein said first end of said lower connector section includes a pair of opposing bolt openings for receiving a U-bolt member therethrough, said U-bolt member for detachably connecting to said trainline fitting.

21. A trainline support bracket in accordance with claim 13 wherein said mutually spaced and substantially parallel side walls or plates are spaced apart by a predetermined distance so that said mutually spaced and substantially parallel side walls or plates contact respective ones of said first and second side walls of said uncoupling mechanism housing.

22. A trainline support bracket for connection to a railcar having a yoke and a coupler attached to a railcar, comprising: a main body including a plate member having an upper edge; a first connector on said main body configured to mount said main body to the coupler so that said main body is supported on or suspended from said coupler, said first connector including an elongate contact pad extending parallel to said upper edge; and a second connector attached to said main body and configured to detachably connect said main body to a trainline fitting in order to support hose fittings, hoses and a gladhand coupling, wherein said first connector includes a pin member connected to and projecting from said plate, said pin member extending into said coupler.

23. A trainline support bracket in accordance with claim 22, further comprising a lower connecting bracket having a first end attached to said main body and a second end provided with said second connector.

24. A trainline support bracket in accordance with claim 22, wherein said main body connector includes a U-shaped member, said plate member being a part of said U-shaped member.

25. A trainline support bracket for connection to a railcar having a yoke and a coupler attached to the railcar and an uncoupling mechanism housing attached to the coupler having first and second side walls with first and second contoured recess members thereon, and having upper and lower compartments, comprising:

a) a trainline support bracket including a main body connector having an upper connector section and a lower connector section, said upper connector section of said main body connector including components for substantially rigidly connecting to the uncoupling mechanism housing of the coupler;

b) said lower connector section having a first end; and c) said first end of said lower connector section for detachably connecting to a trainline fitting in order to support hose fittings, hoses and a gladhand coupling, wherein said components of said upper connector section include a main wall or plate that contacts said first and second side walls of said uncoupling mechanism housing and further include members that extend from said main wall or plate into the upper compartment of said uncoupling mechanism housing.

26. A trainline support bracket in accordance with claim 25 wherein said main wall or plate has an upper edge and wherein said members that extend from said main wall or plate into the upper compartment of said uncoupling mechanism housing include two members equidistant from said upper edge and mutually spaced from one another in a direction parallel to said upper edge.

27. A trainline support bracket in accordance with claim 26 wherein said two members contact said uncoupling mechanism housing and function to support the trainline support bracket thereon.

* * * * *